United States Patent [19]

Furrow

[11] 4,322,172

[45] Mar. 30, 1982

[54] REPLACEABLE REINKER FOR AN INKED RIBBON CARTRIDGE

[75] Inventor: Edward D. Furrow, Crimora, Va.

[73] Assignee: General Electric Company, Waynesboro, Va.

[21] Appl. No.: 159,426

[22] Filed: Jun. 16, 1980

Related U.S. Application Data

[63] Continuation of Ser. No. 973,357, Dec. 26, 1978, abandoned.

[51] Int. Cl.[3] ..... B41J 31/14

[52] U.S. Cl. ..... 400/202.4; 400/208; 118/268

[58] Field of Search ..... 400/194, 195, 196, 196.1, 400/197, 200, 201, 202, 202.1, 202.2, 202.3, 202.4, 208; 101/132.5, 292; 118/268

[56] References Cited

U.S. PATENT DOCUMENTS

| | | | |
|---|---|---|---|
| 1,414,865 | 5/1922 | Delbare | 400/200 |
| 2,724,489 | 11/1955 | Fields | 400/200 |
| 3,145,653 | 8/1964 | Lake | 101/132.5 X |
| 3,241,522 | 3/1966 | Knight | 400/202.2 X |
| 3,989,132 | 11/1976 | Carson | 400/195 |
| 4,152,984 | 5/1979 | Utzinger | 101/292 |
| 4,153,378 | 5/1979 | Scherrer et al. | 400/200 X |

FOREIGN PATENT DOCUMENTS

| | | | |
|---|---|---|---|
| 2332136 | 6/1977 | France | 400/196.1 |
| 579808 | 7/1958 | Italy | 400/202.1 |
| 653984 | 5/1963 | Italy | 400/202.4 |

*Primary Examiner*—Ernest T. Wright, Jr.
*Attorney, Agent, or Firm*—Michael Masnik

[57] ABSTRACT

In a printer, an arrangement for transferring ink from a container carrying ink through an exposed wick to an inked ribbon movable on a roller and housed in a replaceable cartridge. Engaging means are provided on the container, which when the container is inserted into a slot in the wall of the cartridge causes the engaging means to lock on to the cartridge wall by the pressure of a spring. The spring action locks the container to the cartridge as well as moving an exposed wick carried by the container against the ink ribbon for inking purposes.

10 Claims, 6 Drawing Figures

REPLACEABLE REINKER FOR AN INKED RIBBON CARTRIDGE

This is a continuation of application Ser. No. 973,357, filed Dec. 26, 1978, now abandoned.

BACKGROUND OF THE INVENTION

This invention relates to reinkers for use with printers employing an inked ribbon and more particularly to an arrangement for locking an ink bottle to an inked ribbon cartridge while engaging the wick carried by the ink bottle with the ribbon to be inked.

With the advent of high speed printers, particularly those involving impact printing through an inked ribbon, problems have arisen with respect to the frequency of ribbon replacement due to the increased use. In order to reduce the frequency of ribbon replacement, various techniques have been employed. In many applications such as those involving chain or belt printers use has been made of a cartridge containing an endless loop of ribbon. Obviously increasing the volume of ribbon contained in the cartridge reduces the frequency of ribbon replacement. The useful life of a ribbon may also be increased by the use of a ribbon turnover feature as by a mobius loop in an endless ribbon tape. For details of such arrangements, reference may be made to U.S. Pat. No. 3,989,132, dated Nov. 2, 1976, entitled "Ribbon Storage and Transport Mechanism" and assigned to the common assignee. Even after these solutions have been adopted, the need still exists for reducing the frequency of ribbon replacement. In this connection the life of a ribbon has been extended for printing through the use of a reinking device. One such device is an ink container or bottle that transfers ink to the ribbon in a desirable manner. In the past, ink bottles were attached to the printer mechanism itself as contrasted with the ink cartridge or in some instances the ink bottle was hung on the cartridge. When the printer was to be serviced or the cartridge had to be replaced, the ink bottle had to be removed in a separate step before this could be accomplished. It is desirable particularly where space is cramped and ease of cartridge replacement is desirable to provide an arrangement whereby the cartridge and bottle can be removed as an integral unit and if the bottle is to be replaced, it can be quickly and simply detached and another bottle locked in a position with the cartridge.

SUMMARY OF THE INVENTION

Accordingly, it is an object of this invention to provide an improved reinker for use with printers employing an inked ribbon.

It is a further object of this invention to provide an improved reinker for an inked ribbon cartridge.

It is a further object of this invention to provide an improved arrangement for locking an ink container to an inked ribbon cartridge and engaging the wick carried by the ink container with the ribbon to be inked.

It is a further object of this invention to provide an improved arrangement for locking an ink container to a cartridge and coupling the ink container to the ribbon to be inked in substantially a single operation.

DESCRIPTION OF THE PREFERRED EMBODIMENT

Figures 1, 2, 3, 4, 5, 6:
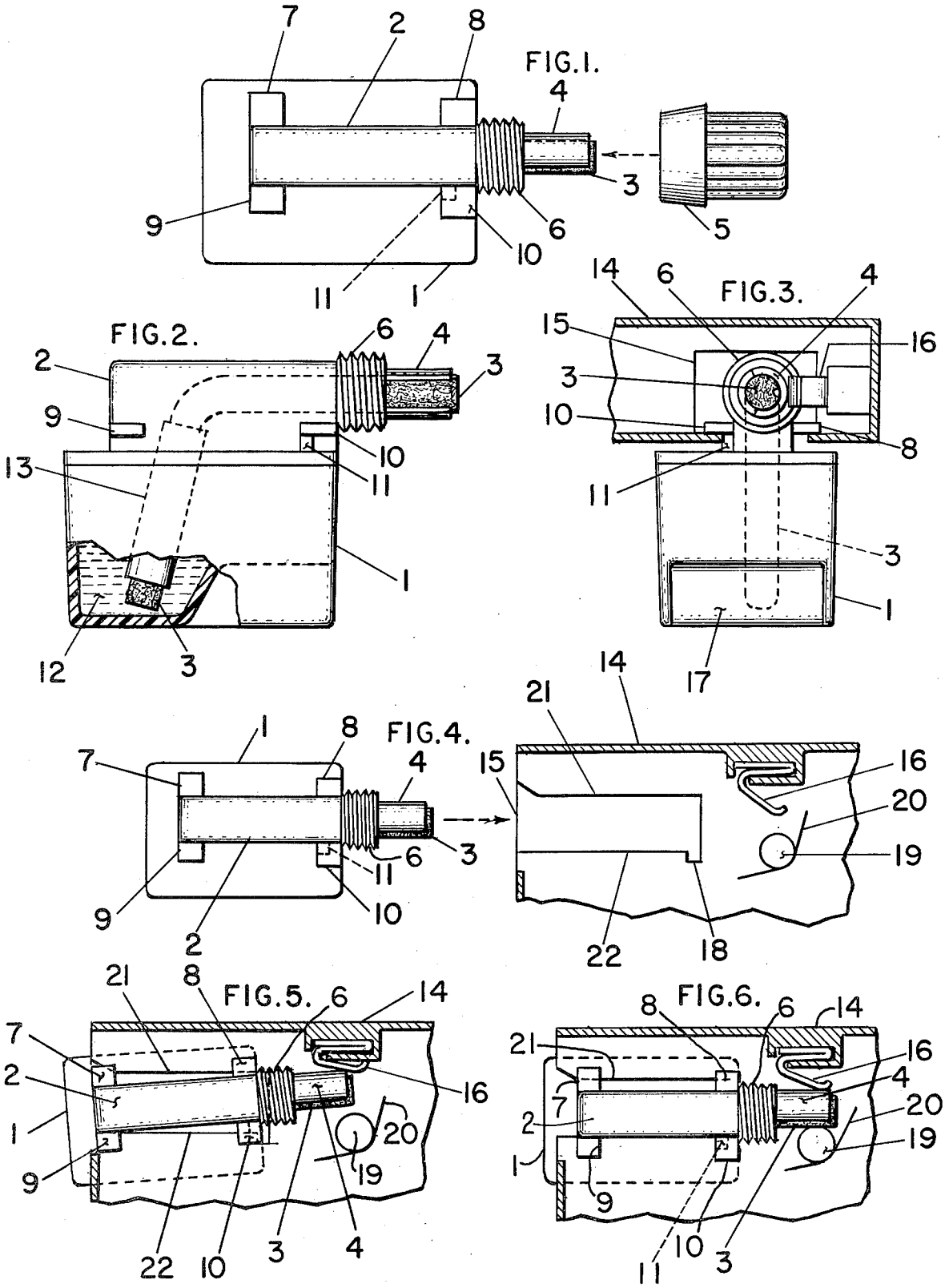
FIG. 1 is a top view of a container carrying ink designed in accordance with one embodiment of this invention.
FIG. 2 is a side view of the container described in FIG. 1.
FIG. 3 is a front view of the container described in FIG. 1 after being inserted into an inked ribbon cartridge.
FIG. 4 illustrates the container and cartridge before loading the ink container into the cartridge.
FIG. 5 illustrates the container and cartridge with the container in the process of being loaded into the cartridge.
FIG. 6 illustrates the ink container inserted into the cartridge and locked in position with the wick carried by the container in position to reink the roller contacting the inked ribbon.

Referring now to FIG. 1 there is shown a container or bottle 1 carrying ink 12 in its lower portion and including an upper portion 2 which carries a wick 3. Wick 3 is supported in a cylindrical rigid housing 4 which is cut away at one side to expose the wick 3. A cap 5 is provided which has threads mating with threads 6 carried by the upper portion 2 of the container 1. The cap 5 is intended to protect the exposed wick 3 during shipment and also to keep the wick 3 from drying out in its exposed portion. Attached to the upper portion 2 of the ink container 1 there are provided four fingers 7, 8, 9 and 10 of which one finger 10 is longer than the other fingers 7, 8 and 9. This longer finger 10 also comprises a tab portion 11 the functions of which will be described shortly. Essentially, these fingers 7 through 10 are intended to loosely engage the bottle 1 with the inked ribbon cartridge 14 during insertion and then to lock the bottle 1 to the cartridge 14 after the insertion process is completed. The exposed portion of wick 3 is intended to contact a roller 19 contacting the ribbon 20 to be reinked when the final insertion step takes place.

Referring to FIG. 2, the lower portion of the ink container 1 carries ink 12. The ink 12 is carried by capillary action by wick 3 which has one end located in the pool of ink 12 and the other end partially exposed by the cut away section of the housing 4. To maintain the wick 3 in the right attitude, a plastic sleeve or a tube 13 is provided within the ink container 1. The tube 13 also facilitates capillary flow of ink 12. The wick 3 may be formed of any suitable material such as a porous felt.

Referring to FIG. 3, there is illustrated a front view of the container 1 inserted into the inked ribbon cartridge 14 with the fingers 8 and 10 of the upper portion 2 of the container 1 resting on the bottom walls of the cartridge 14. The upper portion 2 of the container 1 carrying the exposed wick 3 is inserted through the end wall opening 15 of the cartridge 14 such that the fingers 7 through 10 of the upper portion 2 rest on the lower wall of the cartridge 14. This figure also illustrates the finger 10 as comprising the tab 11 which serves as a locking function as will be shortly described. A spring 16 mounted in the side wall of the cartridge 14 forces the cut away housing 4 and the wick 3 to one side which as will be shown shortly contains the roller 19 with the inked ribbon 20 thereon for reinking purposes. While the container 1 has been shown in the form illustrated in FIG. 3, it is obvious it may take other shapes without departing from the spirit of the present invention. For example, the lower portion of the container 1 in one embodiment included a ramped section in order to accommodate the space available within the printer.

Referring to FIG. 4, the ink bottle 1 with the cap 5 removed is shown prior to insertion into the cartridge 14. Cartridge 14 has an opening 15 in its end wall to receive the upper portion 2 of the ink container 1 and has an opening in its lower wall portion with a notched slot 18 at one far end thereof. The function of this slot 18 will be disclosed shortly. The cartridge 14 contains a spring 16 and a transfer or inking roller 19 around which an inked ribbon 20 is movable.

FIG. 5 illustrates the ink bottle 1 being inserted into the cartridge 14. In the position shown, the housing 4 is shown compressing the spring 16 contained in the cartridge 14 and the fingers 7 through 10 are shown riding on the edges of the opening formed in the bottom of the cartridge 14. The edges of the opening are shown at 21 and 22. Once the container or bottle 1 has been inserted as far as it will go as determined by the front wall of the lower portion of the container 1 abutting the end wall of the cartridge 14 and released—the spring action of spring 16 forces the housing 4 in the direction of the roller 19 bringing the felt wick 3 in contact with roller 19. Ink 12 is carried by capillary action to the exposed felt wick 3 and rubs on the roller 19 and wets it. The ribbon 20 travelling over this roller 19 picks up the ink 12 carried by the roller surface and in this manner is reinked to extend the printing life of the ribbon 20. In addition to bringing the felt wick 3 in contact with the roller 19, spring 16 bearing against the housing 4 also causes the tab 11 to be fitted into the notched slot 18 shown in FIG. 4. By a single action spring 16 provides wick contact with the roller 19 to enable reinking of the ribbon 20 and causes the tab 11 to lock the bottle 1 carrying the ink 12 in the notched slot 18 of the cartridge 14. Whenever the container or bottle 1 needs to be removed it is possible by a single operation to remove both the cartridge 14 and the bottle 1 locked thereto. On the other hand if it is desired only to replace the bottle 1 or remove it the single step of pressing the bottle 1 against the spring 16 unlocks the bottle 1 from the cartridge 14 and removes the wick 3 from the roller 19.

It will be appreciated that modifications may be made in the various structure disclosed in order to produce or to carry out the present invention. Of course modifications of some of the specific steps cited describing embodiments of the invention will occur to those skilled in the art. All such modifications which come within the spirit and teachings of this disclosure are intended to be covered by the following claims.

What I claim as new and desire to secure by Letters Patent of the United States is:

1. In combination, a cartridge containing within its walls an inking roller and inked ribbon which is movable in contact with said roller, means for reinking said ribbon during movement of said ribbon comprising a replaceable container, said container comprising an exposed wick and an ink reservoir containing ink that is released through said exposed wick, said cartridge comprising an opening, engaging means on said container and said cartridge, said engaging means dimensioned to engage said container with said cartridge in response to said wick being inserted into said opening, and means for locking said wick against said roller and said container to said cartridge in response to said exposed wick being inserted into said opening.

2. In combination, a cartridge containing within its walls an inking roller and inked ribbon which is movable in contact with said roller, means for reinking said ribbon during movement of said ribbon comprising a replaceable container, said container comprising an exposed wick and an ink reservoir containing ink that is released through said exposed wick, said cartridge comprising an opening, engaging means on said container and said cartridge, said engaging means dimensioned to engage said container with said cartridge in response to said wick being inserted into said opening, and means for locking said wick against said roller and said container to said cartridge in response to said exposed wick being inserted into said opening and wherein said engaging means comprise fingers on said container which engage at least one wall of the cartridge.

3. An arrangement according to claim 2 wherein at least one wall of said cartridge comprises a notch, said locking means comprising a spring which forces the wick against said ribbon at said roller and forces a finger on said container into said notch locking the container to the cartridge against the force of the spring.

4. In combination, an inked ribbon cartridge for use in printers, said cartridge containing within its walls a roller and inked ribbon which is movable about said roller, means for reinking said ribbon during movement comprising an ink container carrying ink, said container comprising an ink containing portion and a wick, said wick being exposed outside of said container at one end thereof for releasing ink from said ink containing portion externally of said container, said cartridge comprising an opening in at least one wall, fingers extending from said container, said fingers dimensioned to loosely engage said container with said at least one wall at said opening in response to said wick of said container being fitted into said opening, and means for locking said wick against said ribbon at said roller and said container to said at least one wall of said cartridge at said opening.

5. An arrangement according to claim 4 wherein said wick is supported at least at said one end in a rigid housing except for the portion which is exposed for physically contacting said roller.

6. An arrangement according to claim 5 wherein said at least one wall of said cartridge comprises a keyed slot, said locking means comprising a spring which forces the portion of said wick exposed at said one end toward said ribbon at said roller to enable ribbon reinking by said exposed portion of said wick and thereby also forces at least one finger on said container into said keyed slot thereby locking the container to the cartridge against the force of the spring.

7. Apparatus for inking ribbon completely contained in a cartridge wherein the cartridge includes means for interlocking a replacement container to said cartridge and said cartridge further includes an inking roller contained within said cartridge for engaging the ribbon within said cartridge in rolling contact, said replacement container comprising an ink reservoir containing ink and an exposed wick extending into said reservoir, said replacement container further comprising finger means for interlocking said reservoir to said cartridge, said wick being placed in contact with said roller upon said reservoir and cartridge being interlocked.

8. A replacement container for use with a reinker for an inked ribbon cartridge wherein the ribbon cartridge includes locking means for cooperating with said replacement container for locking said container to and releasing said container from said cartridge, said container comprising:

a first portion therein for carrying ink and a second portion therein for carrying a wick, one end of said wick extending exteriorly of said second portion and the other end of said wick extending into said first portion.

and means comprising fingers on the exterior of said container for engaging the locking means of the cartridge.

9. A replacement container as defined in claim 7 and wherein the wick extends into said container through a tube.

10. A replacement container as defined in claim 8 and wherein the wick extends exteriorly of said second portion through a rigid housing.

* * * * *